United States Patent [19]

Chaffee

[11] 4,103,207

[45] Jul. 25, 1978

[54] COUPLED CAVITY TYPE TRAVELING WAVE TUBE HAVING IMPROVED POLE PIECE STRUCTURE

[75] Inventor: Edwin George Chaffee, Redwood City, Calif.

[73] Assignee: Litton Systems, Inc., San Carlos, Calif.

[21] Appl. No.: 776,497

[22] Filed: Mar. 11, 1977

[51] Int. Cl.[2] ..... H01J 25/34

[52] U.S. Cl. ..... 315/3.5; 29/600; 315/3.6; 315/5.35

[58] Field of Search ..... 315/3.5, 3.6, 5.35, 315/39.3; 29/600

[56] References Cited

U.S. PATENT DOCUMENTS

| | | | |
|---|---|---|---|
| 3,324,339 | 6/1967 | Winslow et al. | 315/5.35 |
| 3,398,315 | 8/1968 | Washburn | 315/5.35 |
| 3,885,192 | 5/1975 | Esterson et al. | 315/5.35 |
| 3,958,147 | 5/1976 | Triplett | 315/3.5 |
| 4,041,349 | 8/1977 | Davis | 315/5.35 |
| 4,057,748 | 11/1977 | Davis | 315/5.35 |

*Primary Examiner*—Saxfield Chatmon, Jr.
*Attorney, Agent, or Firm*—Ronald M. Goldman

[57] ABSTRACT

An improved coupled cavity type traveling wave vacuum tube of the type containing serially spaced electromagnetically coupled cavities defined in spaces between serially spaced magnetic pole pieces, each of which contains magnetic ferrule portions projecting from the pole piece walls and bordering an electron beam passage through the pole piece, an electrically conductive nonmagnetic material of high thermal conductivity lines the inner walls of the ferrule, and in which a void formed in between the front and back side walls defining each pole piece is filled with a nonmagnetic material of a high thermal conductivity characteristic positioned in a thermal conducting relationship with said lining portion whereby the ability of the tube to dissipate heat generated therewithin during operation is enhanced and the tube may thereby be operated at higher duty cycles.

4 Claims, 5 Drawing Figures

COUPLED CAVITY TYPE TRAVELING WAVE TUBE HAVING IMPROVED POLE PIECE STRUCTURE

BACKGROUND OF THE INVENTION

The present invention relates to coupled cavity type traveling wave tubes and, more particularly, to an improved pole piece structure for the coupled cavity type traveling wave tube.

The traveling wave tube is a known type of electronic vacuum tube device useful as a component element of microwave electronic systems, such as radar systems, as an amplifier of microwave frequency energy. In its structure and operation, the device operates upon the physical principle of electronic interaction between an electron beam and a microwave frequency signal, which is made to propagate along a slow wave structure of the device, to transfer energy from the electron beam to the microwave frequency signal. The slow wave structure provides the means by which the propagating microwave signal may be caused to traverse a greater length between two axially spaced points so that the effective lateral propagation velocity is reduced or slowed from that of the velocity of light, at which such microwave energy propagates, to the lower velocity of the electrons in the electron beam, a relationship necessary to accomplish the phenomenon of an energy transferring electronic "interaction" between the electron beam and the microwave signal.

The present invention is concerned with traveling wave tubes utilizing slow wave structures of the coupled cavity or interconnected cell type, as variously termed. In this type of slow wave structure, a plurality of interaction cells or cavities are disposed serially and adjacent one another along a common axis. A plurality of axially aligned passages through the cavities is provided for passage of an electron beam. Further, each interaction cavity in the plurality is coupled to an adjacent cavity by means of a coupling aperture in an end wall. Generally the coupling aperture between adjacent cavities are alternately disposed on opposite sides of the electron beam axis, although other arrangements and variations are possible. An electron gun containing a cathode located within the tube furnishes a source of electrons which are formed into a beam and directed along a straight path through the aforedescribed passages in the cavities. Electronic interaction occurs between the electron beam and the microwave frequency signal appearing at the cavity proximate the beam.

Magnetic means are used with the tube to provide magnetic fields that function to confine or focus the electron beam to the axial path so as to minimize electron beam spreading, as hereinafter discussed. This is accomplished in the traveling wave tube by utilizing an iron material for the cavity end wall in the aforedescribed slow wave structure, commonly termed a pole piece, and permanent magnets located outside of the vacuum region of the tube provide the magnetic flux coupled to the pole pieces. Typically, these pole pieces have protruding lips or "ferrules" projecting from the front and back sides of the pole piece walls. These portions surround the electron beam passage to provide a concentrated axially extending magnetic fieled between the ferrule of one pole piece and that of an adjacent pole piece. Secondly, the beam passage so formed in the pole piece between the ends of these lip portions functions as a "drift tube" region.

Although the preceding background is necessarily brief, the interested reader may make reference to various patents in the patent literature for a more detailed understanding of the structure and operation of the coupled cavity type traveling wave tube to which reference is made as follows:

(1) U.S. Pat. No. 2,985,792, issued May 23, 1961, D. J. Bates;

(2) U.S. Pat. No. 3,989,978, issued Nov. 2, 1976, Sauseng et al;

(3) U.S. Pat. No. 3,221,204, issued Nov. 30, 1965, Hant et al;

(4) U.S. Pat. No. 3,181,023, issued Apr. 27, 1965, Hant et al;

(5) U.S. Pat. No. 3,010,047, issued Nov. 21, 1961, Bates;

(6) U.S. Pat. No. 3,602,766, issued Aug. 31, 1971, Grant;

(7) U.S. Pat. No. 3,324,339, issued June 6, 1967, Winslow et al.

As is true in most devices, the operation of the traveling wave tube differs in practice somewhat from theory and is subject to various practical limitations which limit the extent of operation of the device. Thus despite the fact that the aforedescribed magnetic focusing structure is intended to fully confine the electron beam to the maximum diameter of the beam passages, it is not possible to do so completely. Thus, in operation of the tube, when the electron beam is generated, some of the electrons from the beam in fact do strike the pole piece walls. The high kinetic energy released by electrons traveling at a high velocity functions disadvantageously to heat the pole piece and may cause either warping, which disturbs the operation of the tube, or melting of the pole piece material. At increased or higher "duty cycles", i.e. when the electron beam is "on" for longer periods of time, in which higher density electron beams are used in the operation of the tube, the amount of power dissipated at the pole piece by those "errant" electrons becomes quite large and absent any provision for cooling that tube element the power level at which the pole piece warpage or damage occurs is obviously a limitation of the power level at which the traveling wave tube is capable of properly operating. While being unable presently to provide effective tube structure to further reduce or eliminate such electron impingement, various efforts have been undertaken with structure to minimize the heating effect caused by those impinging electrons by the provision of cooling or heat dissipating structures.

Two heat dissipating structures which have been made known to me for providing cooling in this type of traveling wave tube are, first, a pole piece structure fabricated with minute coolant channels therein. Such cooling channels extend from the outer periphery of the pole piece down to the area of the electron beam passage and the ferrules. Additional means are provided which permit the coolant channels to extend outside the tube to a coolant source. In this way, coolant fluid may be pumped into the pole piece and heat is transferred from the pole piece to the fluid, and, in turn, the heated fluid is passed from the traveling wave tube to a heat "sink". This method, as I understand, is very effective as well as flexible, possessing as a drawback the very expensive fabrication techniques used in the construction of the pole pieces themselves. The second cooling structure, as has been related to me, for accomplishing heat dissipation without the use of a fluid coolant source or channels, is one in which strips or layers of copper material which, as is known, has a higher coefficient heat transfer characteristic than the iron pole piece material, is affixed or laminated to each of the front and back side of the iron pole piece. In this way, heat may be conducted from the area of the electron beam passage and pole piece ferrule to the outer periphery of the traveling wave tube where it can be air or liquid cooled.

The aforedescribed prior art structure, in my opinion, presents some limitations in application and use. First, the copper patches were machined to the proper size before they were brazed at high temperature to the iron pole piece material. And because the thermal expansion characteristic of each of the copper and iron are different, it was difficult to braze the patches uniformly and completely to the iron resulting in some warpage of the pole piece. Secondly, in the operation of the traveling wave tube containing those pole pieces any heat generated through electron bombardment of the electron beam passage walls or ferrules is necessarily conducted through the iron of the pole piece to the copper patches, which I view as a less than fully effective heat transfer path.

The present invention is concerned with the dissipation of heat energy caused by electron impingement on the magnetic pole pieces and has as an object an improved tube structure which permits traveling wave tube operation at high power levels without the use of expensive coolant channels or unreliable copper patches. A further object of the invention is to provide a pole piece structure of improved construction capable of rapidly dissipating or transferring heat generated in the pole piece ferrule area about the electron beam passage, which avoids localized heating, results in minimal pole piece warpage and is relatively inexpensive to manufacture. As a further object of the invention, there is provided a new process for fabricating a pole piece structure for a low frequency coupled cavity type traveling wave tube.

SUMMARY OF THE INVENTION

The coupled cavity traveling wave tube, according to the invention, includes means for providing a beam of electrons along a predetermined axis and a slow wave structure for propagating electromagnetic wave energy in such manner that it can interact with the electron beam. The slow wave structure defines a plurality of interaction cavities serially disposed along the electron beam axis and in electromagnetic interacting relationship with the electron beam. An interaction cavity is defined between two spaced walls comprising a magnetic material and forming within the region two spaced magnetic pole pieces. Each pole piece comprises a first and second wall of magnetic material, such as iron, with each of said walls being of substantially the same thickness, and a third wall of electrically conducting nonmagnetic material having high thermal conductivity characteristics, such as copper, sandwiched in between said first and second walls. Each of said first and second walls further includes a protruding ferrule portion extending outwardly and surrounding an axial passage in each of the walls so as to form a drift tube region, and a cylindrical liner of electrically conductive nonmagnetic material of high thermal conductivity characteristics, such as copper, lines the drift tube passage. And the liner is in thermal heat conducting relationship with said sandwiched third wall.

In another aspect of the invention, the method of fabricating the pole piece assembly includes inserting consecutively a thin layer of brazing material into a circular cylindrical well of a predetermined depth surrounding a circular passage in a thick layer of magnetic material, inserting a washer-shaped iron material and said cylindrical copper liner through the passage and brazing said elements together at high temperature to form a laminate. After the laminate has cooled, the surface of the laminate is cut to remove any bows or bulges in the resultant cooled structure so as to flatten the surfaces.

The foregoing objects, advantages and structure characteristic of the present invention, heretofore briefly summarized, becomes more apparent to the reader from consideration of the detailed description of a preferred embodiment of the invention, which follows, considered in conjunction with the accompanying figures of the drawings, illustrative thereof.

DESCRIPTION OF THE PREFERRED EMBODIMENTS

Figure 1:
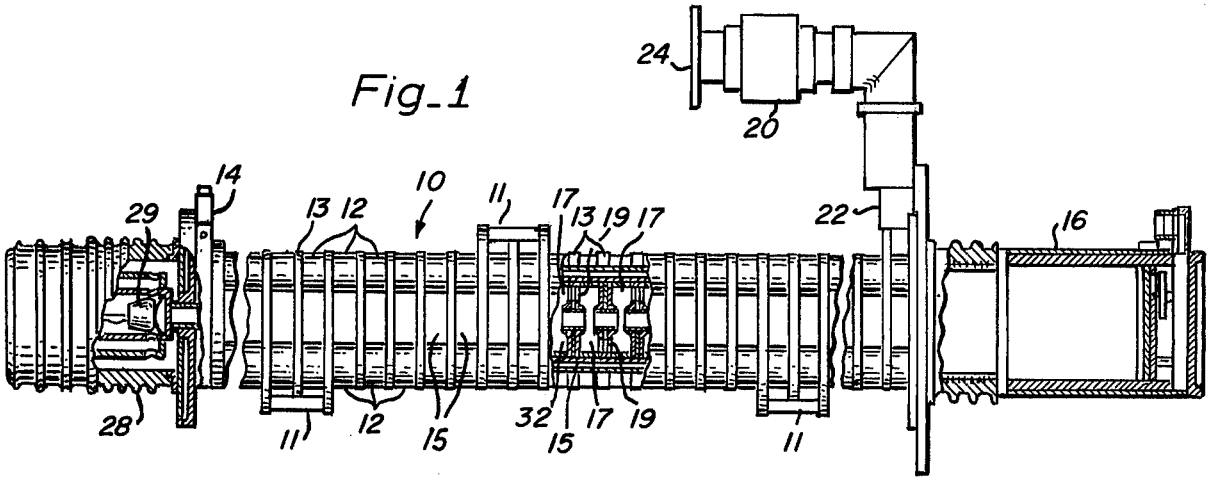
FIG. 1 is an overall view, partly in longitudinal section and partly broken away, drawn not to scale, illustrating a coupled cavity traveling wave tube according to the invention.

Reference is made to FIG. 1 in which the reference numeral 10 designates generally the coupled cavity type traveling wave tube that includes a known arrangement of magnets 12, pole pieces 13 and spacer members 15, which is to be described in detail later. It is sufficient at this point in the description to state that the spacer members and internal portions of the pole pieces function as a slow wave structure for propagating an electromagnetic wave with a phase velocity substantially less than the velocity of light and substantially equal to the velocity of an electron beam. And the magnets and pole pieces constitute a periodic permanent magnet focusing system for focusing the electron beam traversing the length of a slow wave structure. An input coaxial transducer 14 is coupled to the input end of the slow wave structure and is adapted for coupling the assembled traveling wave tube to an external microwave transmission line, not illustrated. The construction of the coupling includes a microwave seal, not illustrated, transparent to microwave energy but capable of maintaining the vacuum within the traveling wave tube and is essentially of a known structure. A waveguide type output transducer 20, including an impedance step transformer 22 and a coupling flange 24 is coupled to the output end of the slow wave structure. The coupling flange includes a microwave window, not illustrated, transparent to microwave energy but capable of maintaining the vacuum within the traveling wave tube and is essentially of a known structure.

An electron gun 28, illustrated partially in section, is disposed at one end of the traveling wave tube and functions in operation to generate and propel a beam of electrons along longitudinal axis 31 of tube 10. The electron gun contains a cathode 29 of electron emissive material and may be of any conventional construction well known in the art, such as exemplified by the electron gun illustrated in U.S. Pat. No. 2,985,792 and U.S. Pat. No. 2,936,393. At the opposite end of traveling wave tube 10, a cooled collector structure 16, illustrated in section, is provided. The collector may be of any conventional structure and functions to collect those spent electrons from the beam which have passed through the tube's interaction region. Inasmuch as the details of the collector are not necessary to an understanding of the invention, reference may be made to collectors described in U.S. Pat. Nos. 2,985,792 and 2,860,277 for exemplary constructions and structure. The tube includes circuit "severs" 11 of conventional construction at several locations which, as is known, function to isolate the output signal from the input signal in a known manner.

The permanent magnets 12 used in the traveling wave tube construction disclosed are pill-shaped magnets, a known alternative to the ring-shaped permanent magnets illustrated in the patents earlier herein cited, and has the purpose of extending a magnetic field through the pole pieces into the vacuum region of the traveling wave tube. Each pole piece has essentially four corner portions and a permanent magnet is located at each corner sandwiched between adjacent pole pieces, with the polarity of the magnets arranged in the same direction parallel to the tube axis. The set of magnets is poled oppositely to the set of magnets situated between the common pole piece and the next adjacent pole piece. This is a conventional prior art magnetic focusing structure.

The cutaway section of FIG. 1 reveals the arrangement of pole pieces 13 and nonmagnetic electrically conductive metal spacers 15 which together form serially axially spaced interaction cavities 17 coupled by coupling holes 19 located off-axis of a central electron beam passage.

Figure 2:
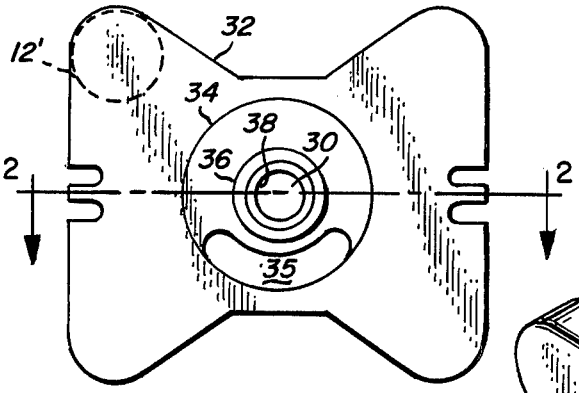
FIG. 2 is a front view of a pole piece used in the traveling wave tube of FIG. 1.

The pole piece assembly, as presented in the front view of FIG. 2 to an enlarged scale, includes a first portion 32 of iron, a ferromagnetic material, and a second circular portion 34, also of iron. Portion 34 contains a protruding cylindrical lip 36 surrounding a circular cylindrical passage 30. A hollow cylindrical-shaped liner of copper material 38 is fixed within lip 36 and lines the passage walls. And a kidney-shaped coupling slot 35 extends through the pole piece. To insure an understanding of the relationship, the position of one of the pill-shaped magnets 12' is represented in dash lines in FIG. 2. Magnets such as 12' are included at each of the four corners of the pole piece in the completed tube.

Figure 3:
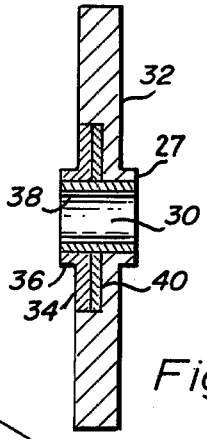
FIG. 3 is a longitudinal sectional view taken along line 2—2 of FIG. 2.

FIG. 3 which shows in cross-section the pole piece of FIG. 2 taken along line 2—2 thereof and in which identical elements are identically labeled shows in section the pole piece portion 34 containing the lip 36, the main pole piece section 32 which similarly contains a protruding lip portion 27 at the pole piece back wall in the form of an annulus or lip surrounding passage 30, which was not visible in FIG. 2. Copper liner 38 is of a hollow cylinder geometry which extends through the length of passage 30 between the ends of lips 27 and 36. Sandwiched in between the flat surfaces of pole piece sections 32 and 34 is a washer-shaped copper member 40. The copper member is seen to be in a thermal conducting relationship with the liner 38 as well as with portions 34 and 32. Although not labeled, very thin brazing material is situated between each of the surfaces of member 40 and pole piece sections 32 and 34, liner 38, and each of the pole piece sections and the member 40 as well. As is recognized, the metal iron material possesses magnetic properties, more specifically ferromagnetic properties, as well as being electrically conductive, has certain heat or thermal conductivity characteristics and certain coefficient or expansion. The copper metal is nonmagnetic but is electrically conductive and has substantially better thermal conductivity characteristics than iron, as well as a larger thermal coefficient of expansion.

Figure 4:
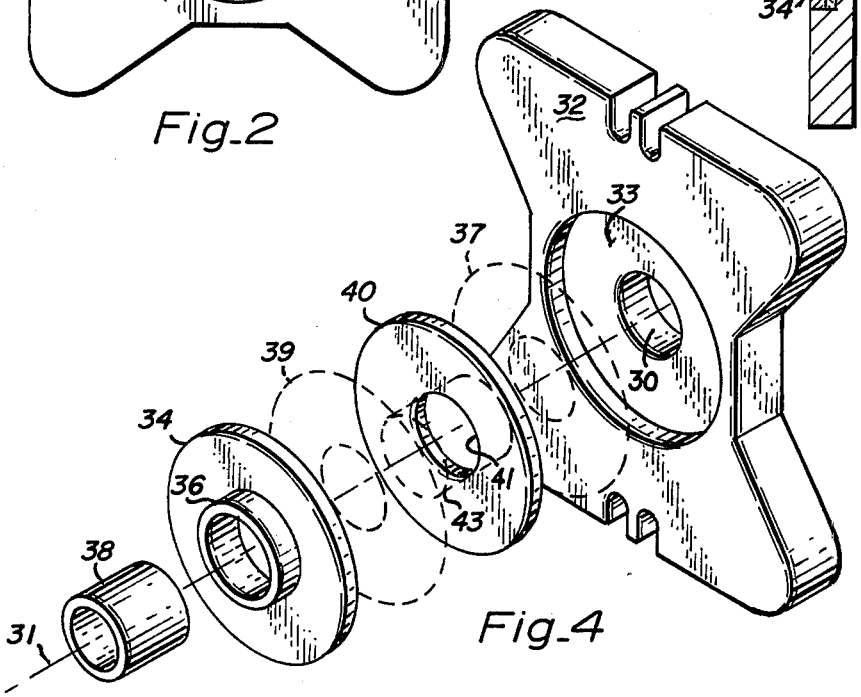
FIG. 4 is an exploded view of the pole piece of FIG. 2.

The overall relationship of the elements of the pole piece is more apparent from the exploded view presented in FIG. 4 to which reference is now made. The exploded view illustrates the assembly of the pole piece in an intermediate stage. When fully assembled according to the teachings of the specification, including the formation of a coupling slot, such as 35 in FIG. 2, the configuration of FIG. 2 results. Thus, pole piece section 32 contains cylindrical passage 30 along the axis 31 and a cylindrical well 33 of a predetermined depth, $T_b$, which depth $T_b$ is less than the total thickness, $T_a$, of pole piece portion 32 and is of a predetermined diameter, $D_1$. The well 33 is coaxial with cylindrical passage 30 which opens into the well. The copper washer-shaped member 40 contains a central circular passage 41 of essentially slightly larger radius than passage 30 and the member is a thickness, $T_c$. The outer diameter of member 40, $D_2$, is slightly less than said $D_1$ of well 33. Intermediate the pole piece section 32 and copper member 40 and represented in dash lines, is a washer-shaped wafer 37 of brazing material, typically a known 50/50 copper-gold alloy brazing composition, which serves to join elements 32 and 40 together. The thickness of this brazing material is usually very small, on the order of 0.038 millimeters. The washer-shaped pole piece portion 34 containing the cylindrical protruding lip 36 is illustrated. Pole piece portion 34 is of an outer diameter, $D_3$, slightly larger than the diameter of washer member 40 but barely less than the diameter $D_1$ of well 33 in pole piece section 32, described as a "clearance" fit. For example, it is desired that the relationship between the diameters be as follows: $D_3 \cong D_1 > D_2$ and suitably $|D_3-D_2| \cong 0.012$ inch, $|D_3-D_1| \cong 0.002$ inch. Another thin washer-shaped member 39 of 50/50 brazing material essentially identical to member 37 is located between elements 34 and 40 and is represented in dash lines which serves to join together elements 40 and 34. Brazing washers 37 and 39 are of essentially the same thickness. The hollow cylindrical copper liner 38 is illustrated in the most left hand portion of this figure. Suitably the outer diameter of liner 38, $D_4$, is less than that of the diameter of passage 30 by an amount sufficient to just accommodate sandwiching of a thin hollow cylinder of brazing material 43, represented in dash lines. The brazing material 43 is approximately the same length as metal copper liner 38 and serves to join the liner to each of the members 34, 32 and 40.

Figure 5:
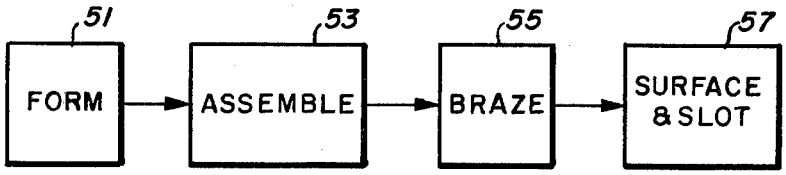
FIG. 5 is a block diagram of the method used to construct the pole piece.

The component elements heretofore described and illustrated are formed to the desired shape and dimension, as represented by block 51 in FIG. 5, using conventional machining techniques, including milling on a milling machine and turning in a lathe, which need not be described in detail. The washer-like or annular portion of member 34 is of a thickness, $T_c$, essentially equal to the thickness, $T_d$, of the underlying annular base portion of well 33 in pole piece portion 32. The elements are assembled together, as represented by block 53 in FIG. 5, by inserting brazing material 37 in well 33, followed consecutively by the copper washer 40, brazing material 39, washer-shaped pole piece portion 34 which, as was earlier noted, fits snugly in the well 33. Then the copper liner 38 and brazing cylinder 43 are pushed into place within passage 30. As is represented by block 55 in FIG. 5, the assembly of metal elements is brazed together in suitable conventional brazing apparatus, not illustrated.

In brazing, the temperature of the assembly is raised to the vicinity of 970° Centigrade, sufficient to melt the brazing material 37 and 39, without melting the other iron and copper elements. As those skilled in the art are aware, the thermal coefficient of expansion of copper is greater than that of iron. As earlier described, the outer diameter $D_2$ of copper member 40 was slightly less than the diameter $D_1$ of well 33 in pole piece portion 34. Accordingly, the copper washer expands to reduce the clearance between its periphery and the walls of well 33, but with enough clearance remaining at the brazing temperature to allow the brazing material on each side of member 50 to flow into the space between the washer and the iron walls bounding well 33. Additionally, brazing material flows throughout the length of the copper liner 38, including that space between copper washer 40 and liner 38. Thereafter in the brazing process the assembly is allowed to cool so that the brazing material solidifies and forms a strong mechanical and thermally conductive bond between the surfaces of the adjoining elements. Hence, the resulting structure may be referred to as a laminate or integral structure. Because copper washer member 40 expanded to a greater degree during the heating portion of the brazing step, it should during cooling contract more than the iron portions 32 and 34, presenting a pulling force on the walls of well 33. For this reason, it is important that the thickness of the iron portion 34 be the same as the thickness remaining between the bottom of well 33 and the opposite side of pole piece portion 32 so as to achieve a balance and minimize the possibility of warpage or bowing of the surfaces.

As a finishing step, represented as block 57 in FIG. 5, the pole piece assembly is placed in a lathe and turned so as to flatten the pole piece surfaces; to cut off any bowed portion. And the kidney-shaped coupling slot, element 35 in FIG. 2, is cut through the assembly in the position illustrated in FIG. 2. Additionally, it is sometimes desired to taper the outer surface of the protruding lips, such as 27 and 36 in FIG. 2, for known purposes. That additional cutting operation may conveniently be performed at this stage of the fabrication process. It is found that if the pole piece is reheated to the high temperatures that are expected within the operating environment of the completed traveling wave tube, and less than the brazing temperatures, that the re-expansion of copper member 40 does not cause significant bending of the surfaces of the iron portion of the pole piece. A particular coupled cavity traveling wave tube constructed with the improved pole pieces obtained performance of a 6 percent duty cycle at about 7 kilowatts average power and about 150 kilowatts peak power.

Even though a portion of the iron material of the pole piece essentially was deleted to effectively reduce the cross-section of magnetic material available to conduct the magnetic flux from the magnets and is replaced by the copper material, a nonmagnetic material, it was found that the cross-section of magnetic material remaining was still sufficient to conduct the flux provided by the magnets, without magnetically saturating the magnetic path, at the desired intensity to the ferrule or lip portion of the pole pieces.

Understanding the foregoing described structure of my invention, the reader skilled in the art may easily grasp its significance. In contrast to the external copper patches of the prior art discussed in connection with the background to this invention, during the brazing steps the present structure essentially "traps" the copper material with its greater thermal coefficient of expansion within the iron "shell" formed between the main pole piece portion 32 and washer-shaped portion 34, which are of the iron material, and that effect leads to a more complete braze between those elements with less ensuing warpage of the assembly. And the final machining is performed only after completion of the brazing steps so as to maintain accuracy of dimension and shape in the laminated pole piece structure. A further result grasped by the reader is that any errant electrons which stray off the beam axis and which would otherwise strike the beam passage walls within the pole piece including the ferrule or lip portions thereof, as in the prior art devices, do so by striking the copper liner 38. The heat so generated is transmitted in great part through the copper liner 38 to the sandwiched copper portion 40 by means of which it may be conducted external of the traveling wave tube. There is thus no need for the heat to pass through iron ferrule or lip portions of the pole pieces and the main heat conducting path is a copper to copper path. This I regard as a significant advantage. Lastly, it appears that the copper liner 38 has the effect of magnetically shielding the iron lip portions from the electron beam. Thus the high gradient of magnetic field which appears near the pole piece ferrule tip or lip portions does not significantly affect the electron beam and I believe that effect beneficial in maintaining focusing of the electron beam during operation of the traveling wave tube.

It is believed that the preceding description of a preferred embodiment of my invention is presented in such detail as to enable one skilled in the art to practice the invention. It is expressly understood however that the details presented for the foregoing purpose are not intended to restrict the scope of my invention, inasmuch as various changes, modifications or substitutions of equivalents, all of which embody the invention, suggest themselves to those skilled in the art upon reading this specification. It is therefore respectfully requested that my invention be broadly construed within the full spirit and scope of the claims appended hereto.

What I claim is:

1. In a coupled cavity type traveling wave tube of the type containing a plurality of serially spaced interaction cavities defined in the space between adjacent pole piece walls of ferromagnetic material and nonmagnetic metal spacers between pole pieces forming a wall about a centrally defined electron beam path through the pole pieces and with microwave energy coupling holes located off axis of the electron beam path through each pole piece for electromagnetically coupling adjacent interaction cavities and means for producing a predetermined magnetic flux through said pole piece, the improvement therein in which the pole pieces comprise:

a pair of walls of a magnetic electrically conductive metal material having a predetermined thermal conductivity characteristic;

each of said walls containing a central cylindrical passage and a protruding lip surrounding said passage, said walls being oriented with said lip portions facing in opposite directions;

a washer-shaped metal member sandwiched in between said walls, and having a passage therein axially aligned with said passages of said walls to define an extended passage;

each of the portions of said walls sandwiching said member being of substantially equal thickness;

a hollow cylindrical metal member defining a cylindrical passage drift tube located within and joined to the walls of said extended passage;

said washer-shaped metal member and said hollow cylindrical member being of a nonmagnetic electrically conductive metal material having a thermal conductivity characteristic greater than said thermal conductivity characteristic of said walls, said members being in a thermal conductive relationship with one another and with said walls, said walls being of sufficient thickness to jointly pass said predetermined flux without magnetically saturating.

2. The invention as defined in claim 1 wherein said sandwiched wall and said hollow member comprise oxygen-free copper.

3. The invention as defined in claim 1 wherein and sandwich further comprises a thin layer of brazing material located in between each of said adjacent walls and members.

4. The method of making a pole piece for a coupled cavity type traveling wave tube from a first layer of magnetic iron material of predetermined thickness containing a passage through the layer and a well recessed into a front surface of the layer coaxial with said passage; a washer-like body of copper material of predetermined thickness less than that of said first layer and of a geometry sufficient to fit within said well with some clearance, a second layer of magnetic iron material of a geometry adapted to clearance fit within said well and containing a central passage coaxial with said passage in said first layer and a hollow copper cylinder and a plurality of pieces of brazing material, comprising:

assembling said body and said second layer into said well with brazing material placed therebetween and assembling said cylinder within said passage with brazing material at the outer surface of said cylinder;

heating said elements to an elevated temperature sufficient to cause said brazing material to flow and braze said elements together;

cooling said elements;

cutting the surface of the resultant assembly to eliminate any surface bowing, and cutting a kidney-shaped passage at a location off axis of said central passage through said layers.

* * * * *